United States Patent [19]

Ziemba

[11] 4,242,963

[45] Jan. 6, 1981

[54] DELAYED ARMING FUZE FOR A SPINNING PROJECTILE

[75] Inventor: Richard T. Ziemba, Burlington, Vt.

[73] Assignee: General Electric Company, Burlington, Vt.

[21] Appl. No.: 945,679

[22] Filed: Sep. 25, 1978

[51] Int. Cl.[3] ..... F42C 15/76; F42C 15/22

[52] U.S. Cl. ..... 102/236; 102/240; 102/245

[58] Field of Search ..... 102/240, 242, 243, 245, 102/231, 233, 235, 236

[56] References Cited

U.S. PATENT DOCUMENTS

| | | | |
|---|---|---|---|
| 3,302,572 | 2/1967 | Lindberg et al. | 102/245 |
| 3,397,640 | 8/1968 | Ziemba et al. | 102/243 |
| 3,479,955 | 11/1969 | Birkist | 102/240 X |
| 3,489,089 | 1/1970 | Kaiser et al. | 102/240 |
| 3,516,359 | 6/1970 | Weber et al. | 102/240 |
| 3,585,935 | 6/1971 | Birkist | 102/240 |
| 3,595,169 | 7/1971 | Ziemba | 102/235 |
| 3,608,494 | 9/1971 | Ziemba | 102/235 |
| 3,616,757 | 11/1971 | Berger | 102/245 |
| 3,994,230 | 11/1976 | Kalin | 102/240 |
| 3,995,557 | 12/1976 | Engel et al. | 102/240 X |

OTHER PUBLICATIONS

Pages 1 and 2 from EODB/TM/TO 60D-35-3-1 (Rev 1) A20 and A23 fuzes.

Pages 1-9 from FSTC-CW-07-100-73, (A23 fuze).

U.S Army Drawing 11731326 (XM714 20mm HS fuze).

U.S. Army Drawing 28113264 (XM714E6 30mm WECOM fuze).

U.S. Army Drawing 23111874 (XM714E5 25 mm fuze).

U.S. Army Drawing 11820583 (XM714E2 20 mm M56 fuze).

*Primary Examiner*—David H. Brown

*Attorney, Agent, or Firm*—Bailin L. Kuch

[57] ABSTRACT

The provision of a delayed arming fuze utilizing a ball rotor, and a firing pin which is captured to the ball rotor by an unwinding ribbon, and which pin precludes the rotor from swinging into alignment for arming until the ribbon has unwound under the sequential presence of setback and spin forces.

3 Claims, 8 Drawing Figures

SAFE

DELAYED ARMING FUZE FOR A SPINNING PROJECTILE

BACKGROUND OF THE INVENTION

1. Field of the Invention

This invention relates to fuzes for ammunition for normally maintaining the ammunition in a safe configuration and for shifting to an armed configuration upon the concurrence of setback and centrifugal forces.

2. Prior Art

Fuzes of this general type are well known in the prior art, and are shown, for example, in U.S. Pat. No. 3,397,640, issued to Ziemba et al on Aug. 20, 1968; U.S. Pat. No. 3,595,169, issued to Ziemba on July 27, 1971; U.S. Pat. No. 3,608,494, issued to Ziemba on Sept. 28, 1971; U.S. Pat. No. 3,489,089, issued to Kaiser et al on Jan. 13, 1970; U.S. Pat. No. 3,302,572, issued to Lindberg et al on Feb. 7, 1967; U.S. Pat No. 3,479,955, issued to Birkigt on Nov. 25, 1969; U.S. Pat. No. 3,516,359, issued to Weber et al on June 23, 1970; U.S. Pat. No. 3,616,757, issued to Berger on Nov. 2, 1971; U.S. Pat. No. 3,585,935, issued to Birkigt on June 22, 1971; U.S. Pat. No. 3,994,230, issued to Kahn on Nov. 30, 1976; U.S. Pat. No. 3,995,557, issued to Engel et al on Dec. 7, 1976; the USAR A-20, A-23 and A-25 projectile fuzes, and the US XM722 and XM714 projectile fuzes. These fuzes employ various combinations of ball rotors, unwinding ribbons and/or dash pots. However, none provides a system which permits the rotor to arm a consistent and predetermined interval of time after both spin and setback forces are present simultaneously. The dash-pot design of the XM714 and XM722 particularly has problems with (1) aging seals, (2) air leaks, (3) piston surge, (4) ambient temperature and pressure sensitivity, (5) spin rate sensitivity and (6) parts lubricity.

SUMMARY OF THE INVENTION

An object of this invention is to provide a delayed arming fuze for a spinning projectile which provides arming after a consistent and predetermined interval of time after both spin and setback forces are present simultaneously.

Another object is to provide such a fuze which includes a point detonation function, a grazing function and a self-destruction function.

Still another object is to provide such a fuze which is insensitive to the effects of temperature, pressure and aging.

A feature of this invention is the provision of a delayed arming fuze utilizing a ball rotor, and a firing pin which is captured to the ball rotor by an unwinding ribbon, and which pin precludes the rotor from swinging into alignment for arming until the ribbon has unwound under the sequential presence of setback and spin forces.

BRIEF DESCRIPTION OF THE DRAWING

These and other objects, advantages and features of the invention will be apparent from the following specification thereof taken in conjunction with the accompanying drawing in which.

DESCRIPTION OF THE INVENTION

Figure 2:
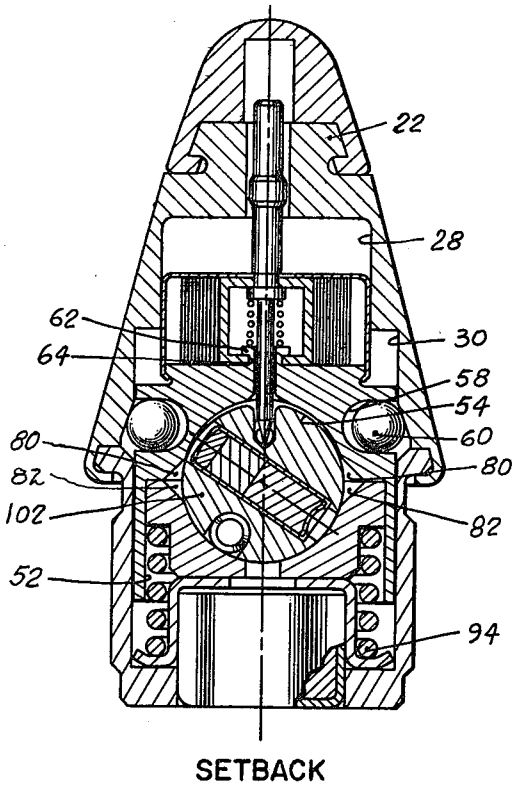
FIG. 2 is a view similar to FIG. 1, showing the components in their configuration upon undergoing setback.

The fuze includes a lower fuze body 10 having an upper interior cylindrical longitudinal bore portion 12, a lower cylindrical longitudinal bore portion 14, an interior annular base portion 16, an exterior annular flange portion 18 and an exterior threaded portion 20 for securing the fuze to the main charge. An upper fuze body 22 is secured to the lower body by means of an annular groove 24 which receives the flange 18, and has a first cyclindrical longitudinal bore portion 26, a second cylindrical longitudinal bore portion 28, a third cylindrical longitudinal bore portion 30, a fourth longitudinal, conical, bore portion 32, and an annular groove 34.

A nose cap 36 is secured to the upper body 22 by means of an annular flange 38 which is received by the groove 34 and has a blind longitudinal bore 40.

A cylindrical upper rotor carrier 50 is disposed in the bores 30 and 12 and includes a lower blind cylindrical longitudinal bore portion 52 opening into a semi-circular recess having a transverse axis 53 and two spaced apart longitudinally extending flat side walls bounding the cylindrical wall 54. The wall 54, at each end thereof, extends into a flat ramp portion 56. The carrier 50 also has two transversely extending blind cylindrical bores 58, each receiving a respective ball 60. The carrier has a boss 62 with an annular recess 64.

A cylindrical lower rotor carrier 70 is disposed within the bore 52 and has a longitudinal bore 72 opening into a semi-circular recess having a transverse axis 53 and two spaced apart longitudinally extending flat side walls bounding the cylindrical wall 74. The wall 74, at each end thereof, extends into a flat ramp portion 76. The cylindrical walls 54 and 74 define a cylindrical opening about the transverse axis 53. The ramp surfaces 56 and 76 define two recesses 80 and 82 opening onto this cylindrical opening. An exterior annular shoulder 84 is formed on the carrier.

A cup 90 is also disposed within the bore 12 and has an exterior annular flange 92 resting on the base portion 16. A helical compression spring 94 is disposed between the flange 92 and the shoulder 84 and biases the lower carrier 70 against the upper carrier 50. The cup has a longitudinal bore 96 thereon which opens into the well 98 of the cup in which a booster charge 100 is disposed.

A cylindrical rotor 102, having an axis of rotation which is perpendicular to the longitudinal axis of the fuze, and coincident with the transverse axis 53, is disposed in the cylindrical opening 54/74. The rotor has a transverse, diametrical bore 104 in which is disposed a detonator 106, a radial blind bore 108 in which is disposed a ball 110, a pair of transverse blind bores (not shown), each adapted to receive the tip of a respective spring retained locking in 116, 118, and a radial blind bore 120 adapted to receive the stab end 122 of a firing pin 124. Each locking pin 116, 118 is disposed in a cup 119*a* which is captured in slots in the upper and lower rotor carriers, and has a leaf spring 119*b* fixed to the outer end of such pin. On assembly, the pins are disposed in their radially inwardmost positions and are held there by the friction of the ends of the leaf springs within the respective cup.

The firing pin 124 further has an annular shoulder 126, a neck portion 128, a body protion 130 and a bearing portion 132. The bearing 132 slides in the bore 26 of the upper fuze body 22.

A two piece hollow split collar 140, 142 has a lower flange disposed in the annular recess 64 of the upper carrier, and an upper flange disposed in the recess of the neck portion 128 of the firing pin. A helical compression spring 144 is disposed on the firing pin and is adapted to bias the pin away from the rotor. The split collar is held together by a metal ribbon 146 wound about the collar as a spool. If desired, a cover 148 may be disposed about the ribbon and fixed to the upper carrier. The split collar captures the firing pin to the upper rotor carrier.

Figure 1:
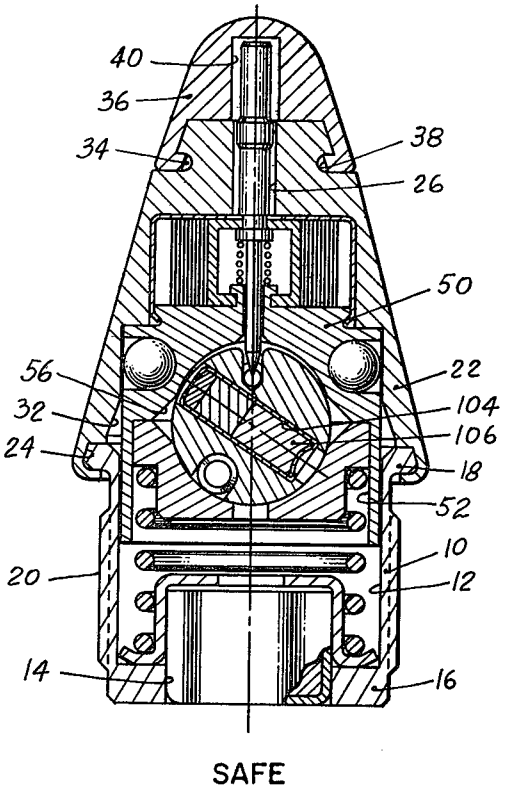
FIG. 1 is a view in longitudinal cross-section of an embodiment of this invention showing the components of the fuze in their safe configuration.

In the safe configuration, as shown in FIG. 1, the firing pin 124 is captured by the split collar and its aft end projects into the bore 120 of the rotor while its forward end abuts the end wall of the blind bore 40 in the cap. The wound up ribbon 146 precludes the opening of the split collar. The captured firing pin precludes rotation of the rotor. The spring inwardly biased pins 116 and 118 also preclude rotation of the rotor.

Upon setback, as shown in FIG. 2, the whole assemblage of upper rotor carrier 50, lower rotor carrier 70, rotor 102, firing pin 124, ribbon 146 and split collar 140 moves aft against the bias of the spring 94. The forward end of the firing pin is spaced from the end wall of the blind bore 40.

Figure 4:
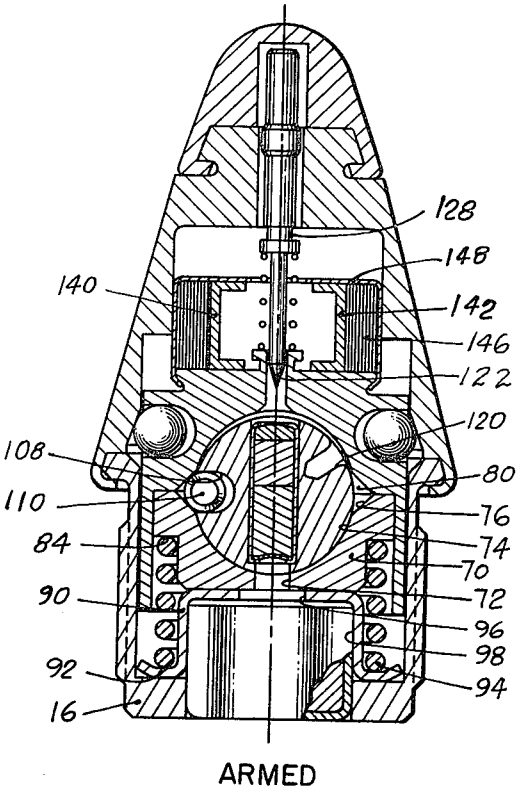
FIG. 4 is a view similar to FIG. 3, showing the components in their armed configuration.
Figure 3:
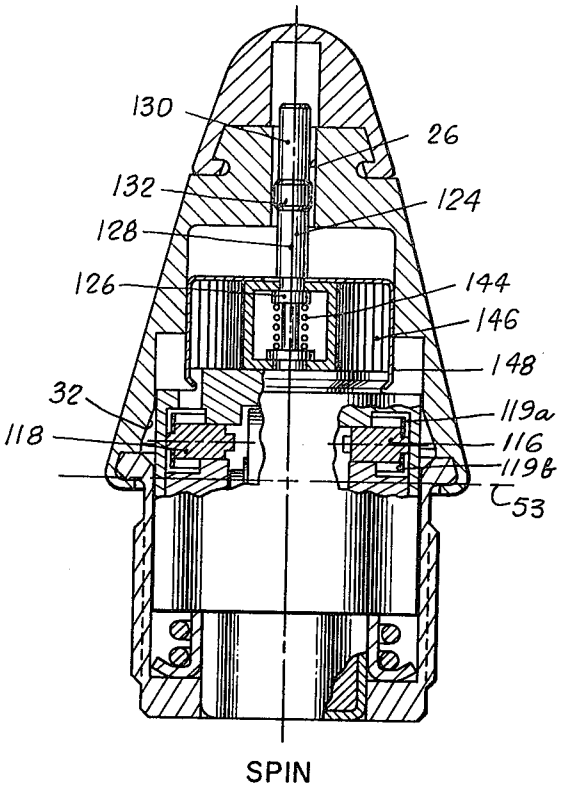
FIG. 3 is a view similar to FIG. 2, showing the components in their configuration upon undergoing spin.

Upon spin, as shown in FIG. 3, the balls 60 move outwardly and engage the ramp surface 56 of the upper fuze body, wedging, or frictionally holding, the upper carrier aft with respect to the fuze body. The pins 116 and 118 move outwardly against the friction of their springs, disengaging from the rotor. The ribbon 146 commences to unwind from the split collar. After a period of time, the ribbon is unwound from the collar and the two parts of the collar 140 and 142 move outwardly, disengaging from the firing pin, and the spring 144 then biases the firing pin forwardly, removing the aft end from the bore 120 of the rotor and abuting the forward end against the end wall of the blind bore 40. The rotor is then free to rotate, and precesses to align the detonator 106 with the longitudinal axis of the fuze, to the armed configuration, as shown in FIG. 4. The ball 110 moves outwardly in its bore 108 and engages the ramp surface 56, wedging, or frictionally holding, the rotor in its aligned position with respect to the rotor carrier.

Figure 5:
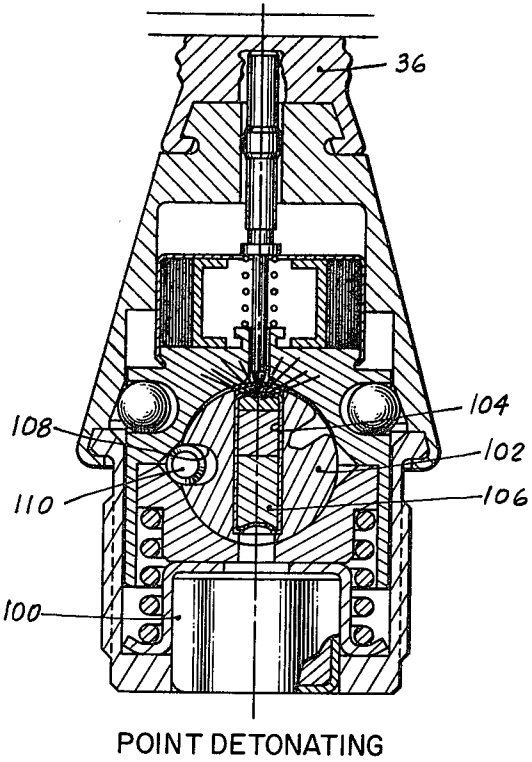
FIG. 5 is a view similar to FIG. 4, showing the components upon point detonation.

Upon point detonation, as shown in FIG. 5, the nose 36 is crushed, moving the firing pin aft, against the bias of the spring 144, to percuss the detonator. The detonator, in turn, ignites the booster 100.

Figure 6:
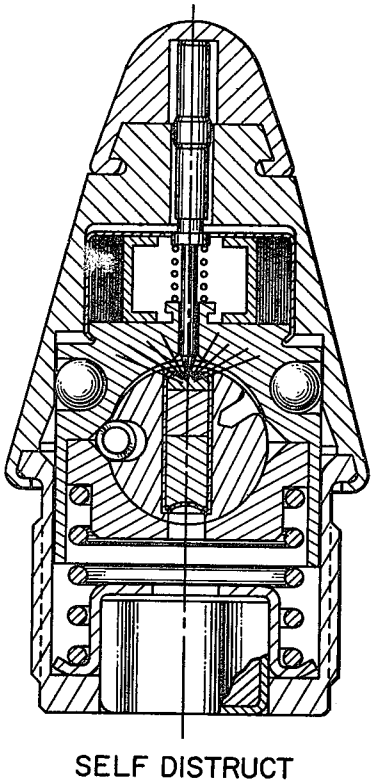
FIG. 6 is a view similar to FIG. 4, showing the components upon self-destruct detonation.

Upon the spin decreasing sufficiently to no longer hold the balls 60 out against the ramp surface 56 to wedge the rotor carrier aft, the spring 94 biases the assemblage forwardly to percuss the detonator against the stationary firing pin, as shown in the self destruct configuration of FIG. 6.

Figure 7:
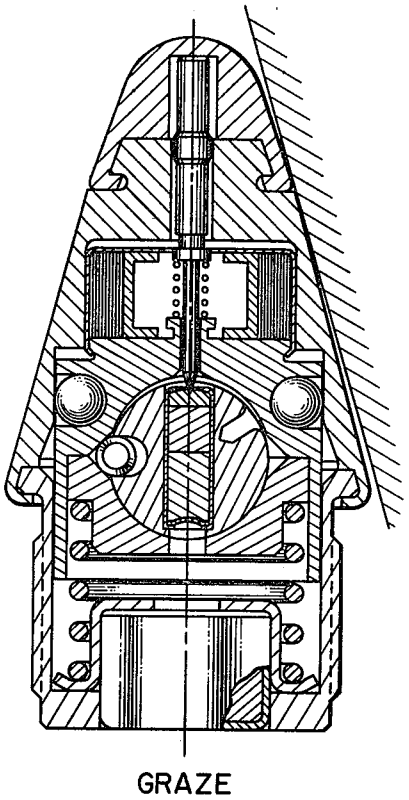
FIG. 7 is a view similar to FIG. 4, showing the components upon graze detonation.

Upon a grazing impact, the spin is also decreased to no longer hold the balls 60 out against the ramp surface 56 to wedge the rotor aft. The spring 94 biases the assemblage forwardly to percuss the detonator against the stationary firing pin, as shown in the graze configuration of FIG. 7.

Figure 8:
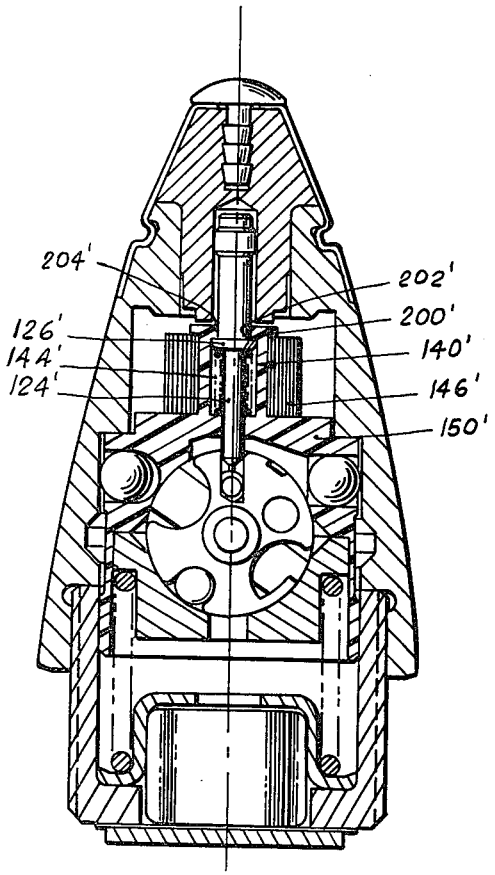
FIG. 8 is a view in longitudinal cross-section of another embodiment of this invention showing the components of the fuze in their safe configuration.

The embodiment shown in FIG. 8 differs, inter alia, from the embodiment of FIG. 1 in that the split collar 140' is integral with the upper rotor carrier 150'. The collar is here shown to be divided along longitudinal planes into eight parts, each part being a cantilevered beam with its proximal end integral with the carrier. The distal parts of the collar provide an outer annular rim 200' which overlies the inner turns of the coil of the unwinding ribbon 146', an inner annular rim 202' which overlies the annulus 126' on the firing pin 124', and a ramp camming surface 204' which permits the annulus 126' to deflect the parts outwardly when the firing pin is pushed in during assembly. The carrier is made of a relatively resilient material, such as glass fiber reinforced nylon 6/10. A creep spring 144' is also provided. Under the application of centrifugal force, the ribbon unwinds away from the collar and the distal ends of the collar deflect outwardly to release the annulus 126' of the firing pin. If desired, the annular rim 200' can be increased in diameter to fully overlie the coil of the unwinding ribbon 146'.

I claim:

1. A time delay fuze having a safed configuration and an armed configuration, for spinning projectiles, comprising:

a housing having a first longitudinal axis and a longitudinal bore therein;

a rotor carrier journaled in said bore of said housing for reciprocation along said first longitudinal axis between an aftmost station and a forwardmost station, and having a cavity therein;

a firing pin journaled in said bore of said housing for reciprocation along said first longitudinal axis between an aftmost station and a forwardmost station;

a rotor disposed in said cavity of said carrier and journaled for rotation about a second axis which is perpendicular to said first longitudinal axis, and having a detonator which is disposed along a diametral third axis of said rotor which is perpendicular to said second axis;

first means including a split collar which is integral with said rotor carrier and an unwinding ribbon for normally interlocking said firing pin to said rotor carrier and to said rotor with said rotor third axis at an angle to said first axis, and upon the continued application of spin, for releasing said firing pin from said rotor carrier and said rotor, second means for biasing said firing pin, when released, out of interlock with said rotor, third means for normally biasing said rotor carrier towards said forwardmost station, fourth means, upon the application of setback force, and thereby the displacement of said rotor carrier to said aftmost station, and during the application of centrifugal force, for retaining said rotor carrier in said aftmost station, and fifth means for normally locking said rotor against rotation in said rotor carrier with said third axis at an angle to said first axis, and upon the application of centrifugal force, for unlocking said rotor, whereby said rotor is free to rotate to align its said third axis with said first longitudinal axis.

2. A fuze according to claim 1 wherein:

said split collar captures said firing pin to said rotor carrier with said firing pin projecting into said rotor.

3. A fuze according to claim 1 wherein:

said split collar includes a plurality of cantilevered beam segments which are adapted to pivot at their proximal ends with respect to said rotor carrier.

* * * * *